US005462179A

United States Patent [19]

Daugherty, Jr. et al.

[11] Patent Number: 5,462,179

[45] Date of Patent: Oct. 31, 1995

[54] SLACKLESS DRAWBAR ASSEMBLY USING A BALL AND RACE ASSEMBLY AT EACH END OF THE DRAWBAR

[75] Inventors: David W. Daugherty, Jr., Bolingbrook; Wajih Kanjo, Lockport, both of Ill.; Michael G. Hawryszkow, Munster, Ind.

[73] Assignee: Westinghouse Air Brake Company, Wilmerding, Pa.

[21] Appl. No.: 238,261

[22] Filed: May 4, 1994

[51] Int. Cl.[6] ..... B61G 9/00

[52] U.S. Cl. ..... 213/62 R; 213/74; 213/61; 105/3

[58] Field of Search ..... 213/62 R, 62 A, 213/63, 75 R, 74, 61; 105/3

[56] References Cited

U.S. PATENT DOCUMENTS

| | | | |
|---|---|---|---|
| 4,456,133 | 6/1984 | Altherr et al. | 213/62 R |
| 5,065,679 | 11/1991 | Wallace et al. | 105/3 |
| 5,232,106 | 8/1993 | Hawthorne et al. | 213/62 R |
| 5,277,323 | 1/1994 | Wallace et al. | 105/3 X |

*Primary Examiner*—Robert J. Oberleitner
*Assistant Examiner*—Kevin D. Rutherford
*Attorney, Agent, or Firm*—James O. Ray, Jr.

[57] ABSTRACT

Slackless drawbar includes female member, having a cavity, engaging end of a railway car. Openings through first and second side walls of cavity. A male member has portion movably disposed in cavity. An aperture formed through such male member. A ball has portion disposed in such aperture and shafts extending from outer surfaces thereof. A portion of one shaft disposed in one opening and a portion of another one disposed in another opening. Such shafts have flat surface portions. A race assembly disposed in such aperture and secured to male member. An inner surface of race surrounds such ball. A second female member, having a cavity, engages end of second car. Openings are formed through second pair of side walls. Another male member has portion movably disposed in second cavity. An aperture formed through the second male member. Another ball includes portion disposed in second aperture and shafts extending from outer surfaces thereof. A portion of one shaft is disposed in one opening and a portion of another one is disposed in another opening. Each such shaft has a flat surface portion. Another race is disposed in such second aperture and secured to such second male member. An inner surface of the second race surrounds such second ball. A securing system secures second end of such first and second male members together. A first pair of wedges engage flat surfaces on such first pair of shafts. A second pair of wedges engage flat surfaces on such second pair of shafts.

34 Claims, 2 Drawing Sheets

SLACKLESS DRAWBAR ASSEMBLY USING A BALL AND RACE ASSEMBLY AT EACH END OF THE DRAWBAR

CROSS-REFERENCE TO RELATED APPLICATIONS

This application is related to an application titled, "A Female Connection Member For A Slackless Drawbar Assembly Using A Ball And Race Assembly" and an application titled, "A Male Connection Member For A Slackless Drawbar Assembly Using A Ball And Race Assembly" which are being filed concurrently herewith and are assigned to the assignee of the present invention. The disclosure of each of these concurrently filed applications is incorporated herein by reference thereto.

1. Field of the Invention

The present invention relates, in general, to slackless type drawbar assemblies which are used in the railway industry to couple together the adjacently disposed ends of a pair of railway type freight cars in a substantially semi-permanent manner and, more particularly, this invention relates to an improved slackless type drawbar assembly which is specifically designed to make use of a ball and race assembly disposed substantially adjacent each end of such assembly to achieve the requisite amount of angling movements which is required between such pair of railway freight cars during their operation on a track structure.

2. Background of the Invention

Prior to the development of the present invention, as is generally quite well known in the railroad industry, such slackless type drawbar assemblies have been in widespread use for a number of years to couple together the adjacently disposed ends of a pair of railway cars in a substantially semi-permanent fashion.

These railway freight cars are normally of the type used in the railroad industry in what is most commonly referred to as dedicated service. Such dedicated service type railway cars will include; by way of example only, cars which are used to haul coal, coke, and/or various other types of raw minerals, light truck and automobile transport carriers, tank cars used for the transport of various types of liquids, as well as, cars which are quite often used to transport various types of building materials. Examples of raw minerals transported in these dedicated service type railway cars include; various ores, cement and stone. The various types of liquids which are known to be transported by such dedicated service type railway cars will at least include a number of different chemicals.

One example of a prior art slackless type drawbar assembly is taught in U.S. Pat. No. 5,000,330. Illustrated therein is a pair of railway cars having their adjacently disposed ends connected together by a slackless drawbar. This particular drawbar, as shown in FIGS. 2 and 3, is constructed to operate with a positioner apparatus.

The drawbar is made from a cast metal, such as steel, and includes a shank portion on which there is provided a non-rotatable fixed end securable to a center sill portion of the car body, and a rotatable end received in the center sill portion of an adjacently disposed car body. Each of the fixed end and rotatable end of the slackless drawbar assembly extends into pocket castings and follower blocks which differ slightly but otherwise the center sill portions and pocket casting parts of both car bodies are substantially identical and are best seen in the enlarged view of FIG. 3A.

The fixed (non-rotatable) end is held in place in the center sill portion of such car body by a key and against a follower member disposed in a pocket casting. The pocket casting is received within the center sill opening, which is defined at it's inboard end by rear stop members. These rear stop members abut against side wall extensions of the pocket casting. A shim may be disposed intermediate the rear stop members and the pocket casting side wall extensions. The shim may be replaced with a thicker shim, should wear require the pocket casting to be spaced further from the rear stop members.

The pocket casting has a cup-like cavity formed by an end wall portion and an encircling skirt portion. Within the cavity the end wall portion presents an inclined face which is formed with a generally shallow V-shaped concavity (as best seen in FIG. 2).

As can best be seen in FIG. 3A, a wedge member is seated in the cavity and frictionally bears against the face of the pocket casting. Such wedge member has an inboard inclined bearing, or friction, surface which is convex-shaped so as to be complementary to the pocket casting face. An outboard wedging surface disposed on the wedge member is formed as a shallow V-shaped concavity that bears against a follower block. The follower block is formed with a complementary inboard wedging convex V-shaped face which bears against such concave outboard surface of the wedge member.

One embodiment of the wedge member, as shown in FIGS. 9 and 10, is provided with a pair of laterally projecting guide tabs to minimize lateral shifting thereof. Lifting or positioning lugs of generally hook shape also project from the sides of such wedge. Access to the lugs and the wedge is made possible by the provision of access openings or slots formed in the skirt portion of the pocket casting and corresponding apertures are provided in the top web of the center sill portion and in a lower channel member (which supports the pocket casting) thereby enabling the insertion of a tool to engage the lugs of the wedge without having to remove the pocket casting itself. The wedge may also be vertically positioned by inserting a tool through an opening, or slot, formed in the pocket casting and the side walls (not shown) of the center sill portion.

Another embodiment of the wedge, as shown in FIG. 3A, is provided with a depending tail piece portion which extends downward through bottom openings in the pocket casting skirt portion and in a lower channel and thereby facilitates vertical repositioning of the wedge member.

The outboard face of the follower block is formed with a spherical concave face which receives a convex spherical butt on the fixed end of the drawbar shank. Retaining the fixed end within the center sill pocket is a key which extends through slots in such center sill side castings and a key slot in the drawbar shank.

The end portion of the key slot is formed with a concave surface concentric to the follower block spherical concave face and convex spherical butt of the drawbar shank. Seated and bearing against the concave surface is a complementary convex face of a key bearing block. This facilitates horizontal angling of the drawbar assembly while the fixed end is held by the key. The bearing block has a groove of semicircular cross section along its edge opposite such convex face. Seated within the groove is a complementary convex edge of the key. A resilient pad is disposed intermediate the top of the key slot and the top face of the key to permit vertical angling of the drawbar assembly while maintaining the key seated in the groove of the bearing block. This facilitates the vertical angling of the drawbar assembly on the key.

The rotatable end of the drawbar assembly is, also, received in a center sill opening of the car body. Within the center sill opening is a pocket casting, having a wedge, and a follower block of structure similar to that described in connection with the stationary or fixed end, although it may extend outwardly of the pocket casting to engage a larger portion of the rotatable end. A shim may be disposed between the rear stop members and the pocket casting wall as, also, described at the fixed end. Similar wedge access slots and apertures are, also, provided in the pocket casting and the top web and sides of the center sill portion.

The rotatable end of the drawbar assembly is formed as a ball having two spherical portions generated from a common center disposed inwardly and outwardly, respectively, of the follower block. These spherical portions are attached to a cylindrical barrel of smaller diameter (to fit within the center sill pocket). The outward spherical surface engages the spherical concave face of the follower block. Retaining the ball end within the center sill pocket is a bottom pulling block segment and an interlocking top pulling block segment (shown in detail in FIGS. 4–8) which engage the inward spherical surface.

The bottom pulling block (as shown in FIGS. 6–8) is generally in the form of a semicircular ring provided with a base portion and a pair of generally upstanding walls portion. The block segment is formed with a concave partially spherical surface which engages the inwardly disposed portion of the spherical ball. The base of the lower pulling block is provided with a generally "V" shaped notch which reduces the lowermost bearing area of the concave surface. All of the spherical surfaces are concentric to lessen the resistance to angling of the drawbar assembly during curve negotiation and the rotary dump operation.

A pair of lug members project from the top of the block and are seated in notches or recesses formed in the upper pulling block segment. Such upper pulling block segment (as shown in FIGS. 4 and 5) is, also, in the general form of a semicircular ring and in which the inner surface is formed as a partially spherical concave surface. This concave surface bears against the inwardly disposed portion of the spherical ball and coacts with the bottom pulling block concave surface to embrace the ball. The upper and lower pulling blocks are formed with complementary semicircular openings through which the shank of the drawbar assembly extends. It is to be noted that the partially spherical surfaces are non-symmetrical with the concave surface of the lower pulling block being notably larger.

Restraining the pulling blocks against longitudinal movement out of the center sill opening is a front stop member. A removable cross plate member is fastened by bolts or the like, across the bottom flanges of the center sill to support the pulling blocks within the opening of such center sill. Channels are, also, removably secured, by bolts or the like, across the center sill to support the pocket casting and the wedge for both the fixed end of the drawbar assembly as well as the rotatable end. This reference considers two features of the construction receiving the drawbar assembly rotatable end to be important. These features are a horizontal shim positioned between the upper pulling block and the top of the center sill, and a cradle positioned on a cross plate to support the drawbar end ball. Both features are illustrated in FIG. 3A and provide means to maintain the pulling blocks, ball and follower in proper orientation.

It is taught that the centers for generating the arcuate surfaces should be horizontally aligned; however when draft (pulling) loads are applied to the drawbar assembly, the ball will tend to rise across the lower pulling block and spread the pulling blocks apart. Should that occur the aforementioned centers for the pulling blocks will separate vertically and lose concentricity with the abutting ball surface portion. The result is to increase resistance to angling and rotation of the drawbar assembly. Additionally, the ball moves so as to cause the wedge member to drop and reposition the follower thereby reducing the available wedge and follower adjustment for wear compensation.

The cradle serves to support the drawbar assembly ball at the proper level for alignment to maintain concentricity with both the follower and pulling block during or immediately after the system is unloaded such as the brief transition from buff to draft loading (or vice versa) or when the car is rotated and the wedge member slightly retracts or during partial disassembly. The cradle has an arcuate surface that is concave to receive the barrel portion of the ball.

Should a slack adjusting wedge member, and/or adjacent parts, become worn to the point such that the wedge member will no longer function to eliminate slack, the wedge member can be lifted by extending a tool through the openings and apertures into engagement with the wedge lugs.

Another method is to insert a tool through the bottom openings in the pocket casting skirt portion and lower channel and applying a vertical force to the bottom of wedge shim, or by pushing upward on a wedge tail piece if so provided. This will allow the worn parts to be spaced further from the rear stop members and a shim member to be disposed between the rear stop members and a the pocket casting wall, or shim to be replaced with a thicker shim to compensate for dimensional changes in worn but still usable parts. Similarly if it becomes necessary to disconnect the drawbar assembly, this can be accomplished at either or both ends by lifting the wedge member and removing either, or both, the key and the pulling blocks (by first removing the cross plate).

SUMMARY OF THE INVENTION

The present invention provides significant improvements in slackless type drawbar assemblies which are specifically designed to connect together a pair of adjacently disposed ends of a pair of railway cars in a substantially semi-permanent fashion. The invented slackless type drawbar assembly includes a first female connection member which is engageable in one end of a center sill portion, disposed beneath a bottom portion of a car body member, of a first railway car. A first cavity is formed in such first female connection member. Such first cavity essentially being defined by a back wall portion and a first pair of side wall portions. There is a first opening formed through a first one of such first pair of side wall portions and an axially opposed second opening is formed through a second one of such first pair of side wall portions. The slackless type drawbar assembly further includes a first male connection member. At least a predetermined portion of a first end of such first male connection member is movably disposed within such first cavity formed in the first female connection member. A first aperture is formed through such predetermined portion of such first end of the first male connection member. At least a portion of a first ball member (hereinafter referred to as a first spherical shaped member) is disposed within such first aperture formed through the first end of such first male connection member. A first pair of horizontally disposed shaft members extend outwardly for a predetermined distance from axially opposed outer surfaces of such first spherical shaped member. At least a portion of one of such first pair of shaft members is disposed within the first opening formed through the first one of such first pair of side wall portions and at least a portion of another one of such first pair of shaft members is disposed within the second opening formed through the second one of such first pair of side wall portions. Moreover, each respective one of such first pair of shaft members includes an axially opposed and substantially flat surface portion formed thereon. There is a first race assembly disposed within such first aperture and secured to the first end of such first male connection member. An inner surface of the first race assembly is disposed around such portion of the first spherical shaped member disposed within the first aperture formed in such first male connection member. The slackless type drawbar assembly of the present invention also includes a second female connection member engageable in one end of a center sill portion, which is secured to a bottom portion of a car body member, of a second railway car. A second cavity is formed in the second female connection member. Such second cavity is, also, essentially defined by a back wall portion and a second pair of side wall portions. There is a third opening formed through a first one of such second pair of side wall portions of the second cavity. An axially opposed fourth opening is formed through a second one of such second pair of side wall portions of such second cavity. A second male connection member is provided which has at least a portion of a first end thereof movably disposed within the second cavity formed in such second female connection member. In addition, a second aperture is formed through a predetermined portion of such second male connection member adjacent the first end thereof. A second ball member (hereinafter referred to as a second spherical shaped member) is provided which has at least a portion thereof disposed within such second aperture formed through the first end of such second male connection member. There is a second pair of horizontally disposed shaft members provided which extend outwardly for a predetermined distance from axially opposed outer surfaces of such second spherical shaped member. At least a portion of one of such second pair of shaft members is disposed within the third opening formed through the first one of such second pair of side wall portions and at least a portion of another one of such second pair of shaft members is disposed within such fourth opening formed through the second one of such second pair of side wall portions. Like the first pair of shaft members, each respective one of such second pair of shaft members has an axially opposed and substantially flat surface portion formed thereon. A second race assembly is disposed within the second aperture and is secured to the first end of such second male connection member. An inner surface of such second race assembly is disposed around such portion of the second spherical shaped member disposed within the second aperture formed in such second male connection member. Another essential element of the slackless drawbar assembly is a means engageable with a second end of such first male connection member and a second end of such second male connection member for securing such second end of such first male connection member to the second end of such second male connection member. The slackless type drawbar assembly of the present invention further includes a first pair of wedge means. A first one of such first pair of wedge means is engaged with a first one of such axially opposed and substantially flat surface portions formed on the first pair of shaft members and a second one of such first pair of wedge means is engaged with a second one of such axially opposed and substantially flat surface portions formed on such first pair of shaft members. Finally, there is a second pair of wedge means provided. A first one of such second pair of wedge means is engaged with a first one of the axially opposed and substantially flat surface portions formed on the second pair of shaft members and a second one of such second pair of wedge means is engaged with a second one of such axially opposed and substantially flat surface portions formed on the second pair of shaft members.

OBJECTS OF THE INVENTION

It is, therefore, one of the primary objects of the present invention to provide an improved slackless type drawbar assembly for connecting together the adjacently disposed ends of a pair of railway cars, in a substantially semi-permanent fashion, in which a ball and race assembly is utilized adjacent each end of such slackless drawbar assembly.

Another object of the present invention is to provide an improved slackless type drawbar assembly for connecting together the adjacently disposed ends of a pair of railway cars, in a substantially semi-permanent fashion, which requires an absolute minimum number of component parts which must move relative to each other when compared to the number of movable components required in the prior art type slackless drawbar assemblies.

Still another object of the present invention is to provide an improved slackless type drawbar assembly for connecting together the adjacently disposed ends of a pair of railway cars, in a substantially semi-permanent fashion, which will generally require substantially less routine maintenance when compared to the routine maintenance requirements of the prior art type slackless drawbar assemblies.

Yet another object of the present invention is to provide an improved slackless type drawbar assembly for connecting together the adjacently disposed ends of a pair of railway cars together, in a substantially semi-permanent fashion, which will exhibit a relatively long service life when compared to the service life of such prior art type slackless drawbar assemblies.

A further object of the present invention is to provide an improved slackless type drawbar assembly for connecting together the adjacently disposed ends of a pair of railway cars, in a substantially semi-permanent fashion, which will be significantly more cost effective for the user.

An additional object of the present invention is to provide an improved slackless type drawbar assembly for connecting together the adjacently disposed ends of a pair of railway cars, in a substantially semi-permanent fashion, which is relatively easy to retrofit into existing railway cars.

Still yet another object of the present invention is to provide an improved slackless type drawbar assembly for connecting together the adjacently disposed ends of a pair of railway cars, in a substantially semi-permanent fashion, which is significantly lighter in weight than a conventional type coupler which requires yokes, draft gear, draft key members and follower members.

Yet still another object of the present invention is to provide an improved slackless type drawbar assembly for connecting together the adjacently disposed ends of a pair of railway cars, in a substantially semi-permanent fashion, which is relatively easy to assemble.

It is a still further object of the present invention to provide an improved slackless type drawbar assembly for connecting together the adjacently disposed ends of a pair of railway cars, in a substantially semi-permanent fashion, which includes an absolute minimum number of frictionally engageable wear surfaces.

An additional object of the present invention is to provide an improved slackless type drawbar assembly for connecting together the adjacently disposed ends of a pair of railway cars, in a substantially semi-permanent fashion, which does not require any specialized tools and/or other equipment to install on a railway car.

Although a number of specific objects and advantages of the present invention have been described in some detail above, various other objects and advantages of the slackless type drawbar assembly incorporating a ball and race assembly at each end thereof will become much more readily apparent to those persons who are skilled in the railway car coupling art from the following more detailed description of the invention, particularly, when such description is taken in conjunction with both the attached drawing Figures and with the appended claims.

BRIEF DESCRIPTION OF THE PRESENTLY PREFERRED EMBODIMENTS OF THE INVENTION

Figure 1:
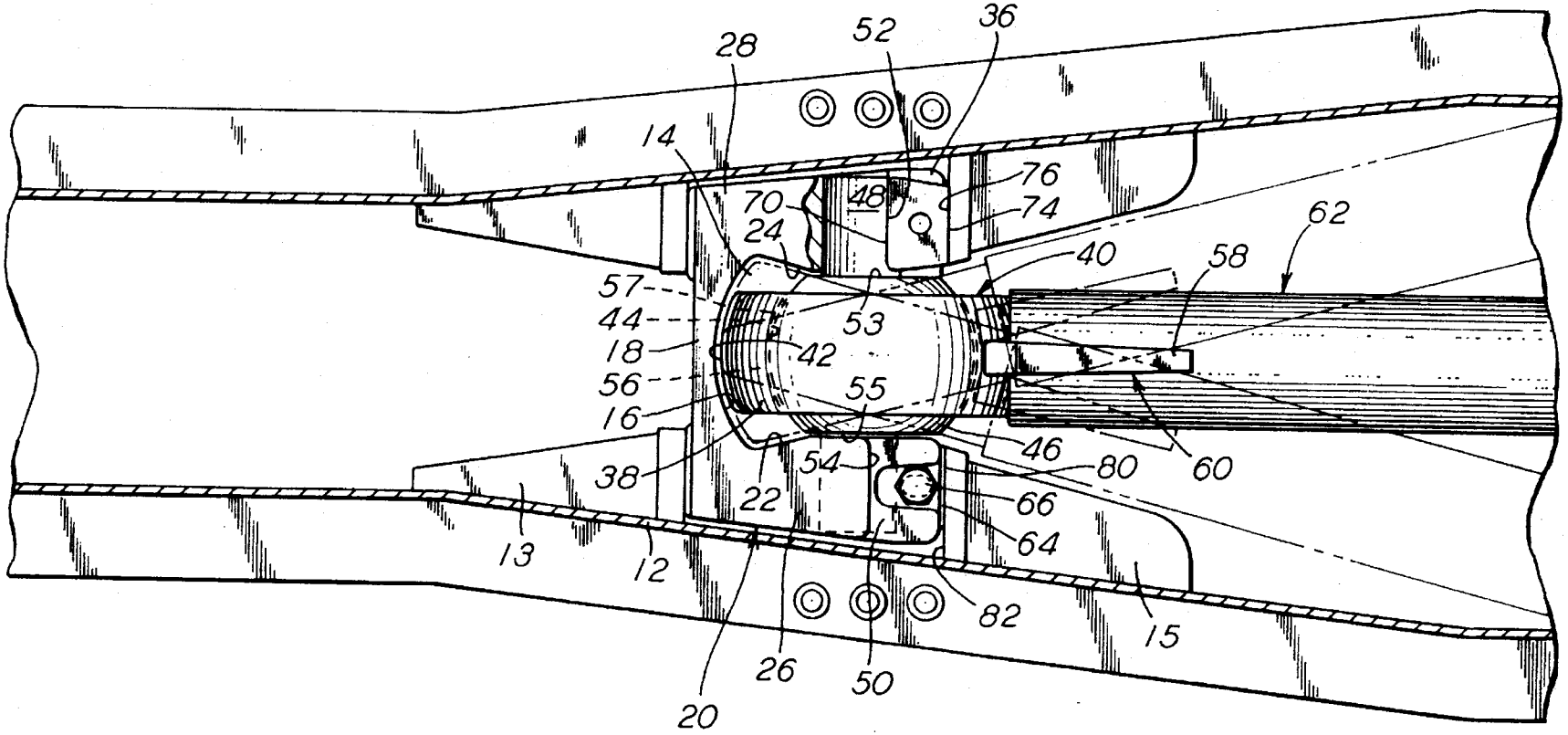
FIG. 1 is a top view, partially in cross section, which illustrates one presently preferred embodiment of the improved slackless type drawbar assembly constructed according to the present invention.

Prior to proceeding to the considerably more detailed description of the present invention, it should be noted that, for the sake of clarity, identical components, which have identical functions, have been designated with identical reference numerals throughout the several views that have been illustrated in the drawings.

Figure 2:
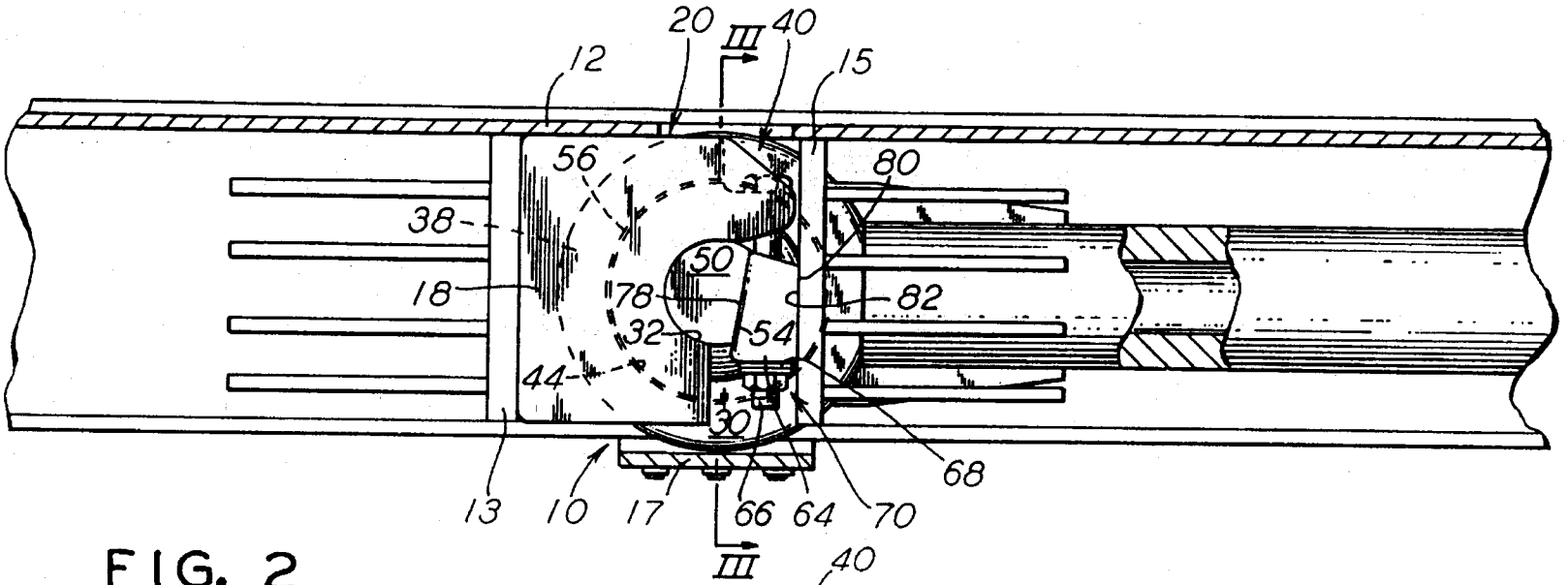
FIG. 2 is a side elevation view, partially in cross section, of such slackless type drawbar assembly illustrated in FIG. 1.
Figure 3:
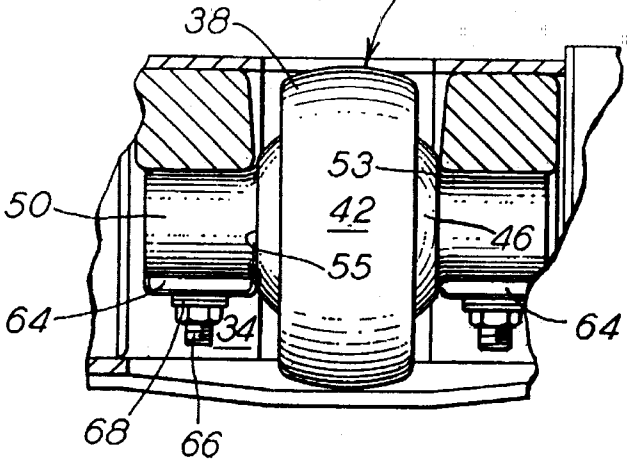
FIG. 3 is an end view taken along the lines III—III of FIG. 1 which is, also, partially in cross section.

Now reference is made, more particularly, to the attached drawing FIGS. 1 through 3. Illustrated therein is an improved slackless type drawbar assembly, generally designated, 10 for connecting together the adjacently disposed ends (not shown) of a pair of railway cars (not shown) in a substantially semi-permanent fashion. Such slackless drawbar assembly 10 includes a first female connection member, generally designated, 20 which has a first predetermined configuration. The shape, of the outer surface portions of such first predetermined configuration, of the first female connection member 20 is designed in such a manner that will enable the first female connection member 20 to be substantially disposed entirely within and engaged with a first end of a center sill portion 12 secured to a bottom portion (not shown) of a car body member (not shown) of a first railway car (not shown).

First female connection member 20 is restrained against any longitudinal movement within the center sill portion 12 in a first direction by rear stop members 13 and in an axially opposed second direction by front draft stop members 15. There is a support plate member 17 provided which is removably secured to the center sill portion 12 beneath the first female connection member 20. Such support plate member 17 prevents downward vertical movement of such first female connection member 20.

A first cavity 14 is formed in such first female connection member 20. Such first cavity 14 is at least defined by an inner surface 16, having a second predetermined configuration, of a back wall portion 18 and, respective, inner surfaces 22 and 24 of a first pair of side wall portions 26 and 28. Each of such inner surfaces 22 and 24 have a third predetermined configuration.

The second predetermined configuration of the inner surface 16 of such back wall portion 18 will, preferably, be generally concave in both a vertical direction and a horizontal direction. The third predetermined configuration of such inner surfaces 22 and 24, on the other hand, will normally exhibit a convex shape in at least a horizontal direction. Preferably, such inner surfaces 22 and 24 will have a, generally, convex shape in both such horizontal direction and in a vertical direction.

Formed through the first side wall portion 26 of such first pair of side wall portions 26 and 28 is a first opening 30. Such first opening 30 has a fourth predetermined configuration. In this embodiment, such fourth predetermined configuration of the first opening 30 will at least include each of a first generally round portion 32 and a first generally open bottom portion 34. The specific function of such first round portion 32 and the first open bottom portion 34 of such first opening 30 will become more clear as the description of the present invention proceeds.

There is an axially opposed second opening 36, having a fifth predetermined configuration, formed through the second side wall portion 28 of such first pair of side wall portions 26 and 28. It is presently preferred that the fourth predetermined configuration of such first opening 30 will be substantially identical to such fifth predetermined configuration of the second opening 36. However, it is to be understood that the present invention is not to be limited thereto.

The slackless drawbar assembly 10 further includes a first male connection member, generally designated, 40 which has a sixth predetermined configuration. At least a portion of a first end 38 of such first male connection member 40 is disposed for rotatable movement within the first cavity 14 formed in such first female connection member 20.

The end surface 42 of such first end 38 which is disposed facing the inner surface 16 of such back wall portion 18 of such female connection member 20 will exhibit a generally convex shape in each of a vertical direction and a horizontal direction. Preferably, except for such end surface 42, the first end 38 of such male connection member 40 will be generally rectangular in shape except for radius portions adjacent the outer edges thereof.

A first aperture 44 is formed through a predetermined portion of such first male connection member 40 adjacent the first end 38 thereof. According to the presently preferred embodiment of the invention, such first aperture 44 will be generally round and have a first predetermined diameter.

Nevertheless, it is to be understood that various other shapes can be readily envisioned for such first aperture 44 and that such various other shapes are contemplated to be within the broad scope of the claims directed to such invention.

Further included in the slackless drawbar assembly 10 is a first spherical shaped member 46. At least a predetermined portion of such first spherical shaped member 46 is disposed within the first aperture 44 formed through such first end 38 of the first male connection member 40. In the presently preferred embodiment of the invention, the outer surface of the first spherical shaped member 46 will be a polished surface. Still more preferably, the polished outer surface of the first spherical shaped member 46 will be a polished chrome plated surface.

There are a first pair of substantially horizontally disposed shaft members 48 and 50 which extend outwardly for a predetermined distance from axially opposed outer surfaces 52 and 54 of such first spherical shaped member 46. At least a portion of a first shaft member 50 is disposed within the generally round portion 32 of such first opening 30 formed through such first side wall portion 26 and at least a portion of a second shaft member 48 of such first pair of shaft members 48 and 50 is disposed within the second opening 36 formed through the second side wall portion 28 of such first pair of side wall portions 26 and 28.

Each respective one of such first pair of shaft members 48 and 50 includes an axially opposed and substantially flat surface portion 52 and 54 formed thereon. The function served by the substantially flat surface portions 52 and 54 will become clear as the detailed description of the invention proceeds.

Although the invention is not to be limited thereto, it is presently preferred that both such first spherical member 46 and such first pair of shaft members 48 and 50 will be formed as an integral single piece component.

There is a first race assembly 56, having at least a portion thereof, disposed within and adjacent the perimeter of such first aperture 44. Such first race assembly 56 being secured to such first end 38 of the first male connection member 40. According to the presently preferred embodiment of the invention, such first race assembly 56 will be secured to the first end 38 of such first male connection member 40 in a removable manner. However, it is within the scope of the present invention for such first race assembly 56 to be welded to such first end 38 of the male connection member 40.

An inner surface of such first race assembly 56 is disposed around such portion of the first spherical shaped member 46 positioned within such first aperture 44 formed in such first male connection member 40. In this manner, the first spherical shaped member 46 is, preferably, held substantially centered within such first aperture 44.

In one alternative form of the presently preferred embodiment of the invention, there will be provided a substantially solid type lubricating liner member 57, such as manufactured by Kahr Rearing Co. and marketed by them under the tradename "KARLON", disposed between the outer surface of such first spherical shaped member 46 and the inner surface of such first race assembly 56.

The slackless type drawbar assembly 10, of the present invention, includes a second female connection member (not shown), which, preferably, is a mirror image of the first female connection member 20. Such second female connection member has a seventh predetermined configuration which, preferably, is substantially identical to the first predetermined configuration of such first female connection member 20.

Additionally, such second female connection member is engageable in one adjacently disposed end (not shown) of a center sill portion (not shown) which is secured to a bottom portion of a second car body member (not shown) of a second railway car (not shown).

A second cavity which is, preferably, substantially identical to such first cavity 14 formed in such first female connection member 20 is formed in the second female connection member. Such second cavity being defined by an inner surface, having an eighth predetermined configuration, of a back wall portion and respective inner surfaces of a second pair of side wall portions. Each of the respective inner surfaces of such second pair of side wall portions having a ninth predetermined configuration.

In the presently preferred embodiment of the invention, the eighth predetermined configuration of such inner surface of the back wall portion will be substantially identical to the second predetermined configuration of the inner surface 16 of the back wall portion 18 of such first female connection member 20. Furthermore, the ninth predetermined configuration of such respective inner surfaces of such second pair of side wall portions will, preferably, be substantially identical to the third predetermined configuration of the respective inner surfaces 22 and 24 of the first pair of side wall portions 26 and 28.

Formed through the first side wall portion of such second pair of side wall portions is a third opening, which has a tenth predetermined configuration which, preferably, is substantially identical to the fourth predetermined configuration of such first opening 30. In the presently preferred embodiment, such tenth predetermined configuration of the third opening will, also, at least include each of a third generally round portion and a third generally open bottom portion. The specific function of such third round portion and the third open bottom portion of such third opening will become more clear as the description of the present invention proceeds.

There is an axially opposed fourth opening, having an eleventh predetermined configuration, formed through the second one of such second pair of side wall portions of such second cavity. As has been previously discussed above, with respect to the first opening 30 and the second opening 36, it is presently preferred that the tenth predetermined configuration of such third opening will be substantially identical to such eleventh predetermined configuration of the fourth opening. Once again, however, the present invention is not to be limited thereto.

In the present invention, the improved slackless type drawbar assembly 10 further includes a second male connection member which has a twelfth predetermined configuration. Although the invention is not to be limited thereto, such twelfth predetermined configuration will, preferably, be substantially identical to the above-mentioned sixth predetermined configuration of such first male connection member 40. At least a portion of the first end of such second male connection member is disposed for rotational movement within the second cavity formed in such second female connection member.

A second aperture is formed through a predetermined portion of such second male connection member adjacent the first end thereof. According to the presently preferred embodiment of the invention, the second aperture will be substantially identical to such first aperture 44. In other words, the second aperture will, preferably, be generally round and have a second predetermined diameter.

However, it is to be understood that various other shapes can be envisioned, by persons who are skilled in the slackless type drawbar assembly art, for such second aperture and that any of these various other shapes are contemplated to be within the broad scope of the claims directed to such invention.

A second spherical shaped member, preferably, substantially identical to such first spherical shaped member 46 is provided. At least a portion of such second spherical shaped member is disposed within the second aperture formed through the first end of such second male connection member. This second spherical shaped member has a second pair of horizontally disposed shaft members extending outwardly for a predetermined distance from axially opposed outer surfaces thereof.

At least a portion of a first one of such second pair of shaft members is disposed within the generally round portion of such third opening formed through a first side wall portion of such second pair of side wall portions and at least a portion of a second one of such second pair of shaft members is disposed within such generally round portion of the fourth opening formed through the second side wall portion of such second pair of side wall portions.

Like the first pair of shaft members 48 and 50, each respective one of such second pair of shaft members includes axially opposed and substantially flat surface portions formed thereon. Preferably, such second spherical member and the second pair of shaft members will, also, be formed as an integral single piece component.

A second race assembly, having at least a portion thereof disposed within such second aperture, is, preferably, secured in a removable manner to the first end of such second male connection member. Similar to the first race assembly 56, an inner surface of such second race assembly is positioned around that portion of the second spherical shaped member that is disposed within the second aperture formed in such second male connection member.

In the presently preferred embodiment of the invention the second race assembly will, also, be substantially identical to such first race assembly 56.

Additionally, in the presently preferred embodiment of the invention, there will be provided another substantially solid type lubricating liner member, such as manufactured by Kahr Rearing Co, disposed between the second spherical shaped member and the inner surface of the second race assembly.

A means, generally designated, 60 is engageable with both a second end 58 of such first male connection member 40 and a second end (not shown) of such second male connection member for securing the second end of such first male connection member to the second end of such second male connection member.

Such means 60 may be as simple as providing a weldment which secures the second end 58 of such first male connection member 40 to the second end of such second female connection member. In this case, the second end 58 of such first male connection member 40 and the second end of such second female connection member will have a predetermined length which will be at least sufficient to provide the spacing required between the adjacently disposed ends of the pair of railway cars connected together by the improved slackless drawbar assembly 10 to enable such railway cars to negotiate any curves encountered on a track structure.

In the presently preferred embodiment of the invention, however, such securing means 60 will include a bar or pipe-like member 62 disposed intermediate and secured to the second end 58 of the first male connection member 40 and to the second end of such second male connection member.

When such pipe-like member 62 is utilized for securing such second end 38 of the first male connection member 40 and such second end of the second male connection member together, then such second end 38 of each of such first male connection member 40 and the second end of such second male connection member will, preferably, include a male member 58 inserted into respective opposed ends of said pipe-like member 62. On the other hand, when a solid bar-like member is used to secure such second end 38 of the first male connection member 40 and the second end of such second male connection member together, then such second end 38 of the first male connection member 40 and the second end of such second male connection member will, preferably, include a sleeve-like portion to receive a respective end of the bar-like member therein.

Further provided in the presently preferred embodiment of such slackless type drawbar assembly 10 is a first pair of wedge means, generally designated, 70. Such wedge means 70 includes a wedge member 64 having a bolt 66 disposed therethrough in a longitudinal direction and washer means 68. Preferably such washer means 68 will be Belleville type washers.

A first one of such first pair of wedge means 70 includes a tapered surface 72 engaged with a first flat surface portion 52 of such axially opposed and substantially flat surface portions 52 and 54 formed on the first pair of shaft members 48 and 50. A substantially flat and vertically disposed surface 74 disposed on the first one of the wedge means 70 is engaged with a mating vertically disposed surface 76 of a respective front draft stop member 15. The second one of such first pair of wedge means 70 includes a tapered surface 78 engaged with a second flat surface portion 54 of such axially opposed and substantially flat surface portions 52 and 54 formed on the first pair of shaft members 48 and 50. There is a substantially flat and vertically disposed surface 80 on the second one of the wedge means 70 engaged with a mating vertically disposed surface 82 of a respective front draft stop member 15.

A second pair of wedge means (not shown) is provided in the slackless drawbar assembly 10 of the present invention. Such second wedge means, also, includes a wedge member having a bolt disposed therethrough in a longitudinal direction and washer means. Preferably, such washer means will be Belleville type washers.

A first one of such second pair of wedge means includes a tapered surface engaged with a first flat surface portion of such axially opposed and substantially flat surface portions formed on the second pair of shaft members. A substantially flat and vertically disposed surface on the first one of the wedge means is engaged with a mating vertically disposed surface of a respective front draft stop member. The second one of such second pair of wedge means includes a tapered surface engaged with a second flat surface portion of such axially opposed and substantially flat surface portions formed on the second pair of shaft members. There is a substantially flat and vertically disposed surface on the second one of the wedge means engaged with a mating vertically disposed surface of a respective front draft stop member.

While a number of presently preferred and various alternative embodiments of the present invention have been described in detail above, with particular reference to the drawing Figures, it should be understood by those persons who are skilled in the railway car type coupling art that it is possible for a number of additional modifications and/or other adaptations of such slackless type drawbar assembly to be made without departing from either the spirit or the scope of the appended claims.

We claim:

1. An improved slackless type drawbar assembly for connecting adjacently disposed ends of a pair of railway cars together in a substantially semi-permanent manner, said slackless drawbar assembly comprising:

(a) a first female connection member, having a first predetermined configuration, engageable in one end of a center sill portion, which is secured to a bottom portion of a car body member, of a first railway car;

(b) a first cavity formed in said first female connection member, said first cavity being defined by a back wall portion, having a second predetermined configuration, and a first pair of side wall portions, having a third predetermined configuration;

(c) a first opening, having a fourth predetermined configuration, formed through a first one of said first pair of side wall portions;

(d) an axially opposed second opening, having a fifth predetermined configuration, formed through a second one of said first pair of side wall portions;

(e) a first male connection member, having a sixth predetermined configuration, at least a portion of a first end of said first male connection member being movably disposed within said first cavity formed in said first female connection member;

(f) a first aperture formed through a predetermined portion of said first male connection member adjacent said first end thereof;

(g) a first spherical shaped member, at least a portion of said first spherical shaped member being disposed within said first aperture formed through said first end of said first male connection member;

(h) a first pair of horizontally disposed shaft members extending outwardly for a predetermined distance from axially opposed outer surfaces of said first spherical shaped member, at least a portion of a first one of said first pair of shaft members being disposed within said first opening formed through said first one of said first pair of side wall portions and at least a portion of a second one of said first pair of shaft members being disposed within said second opening formed through said second one of said first pair of side wall portions, each respective one of said first pair of shaft members has an axially opposed and substantially flat surface portion formed thereon;

(i) a first race assembly having at least a portion thereof disposed within said first aperture and secured to said first end of said first male connection member, an inner surface of said first race assembly being disposed around said portion of said first spherical shaped member disposed within said first aperture formed in said first male connection member;

(j) a second female connection member, having a seventh predetermined configuration, engageable in one end of a center sill portion, which is secured to a bottom portion of a car body member, of a second railway car;

(k) a second cavity formed in said second female connection member, said second cavity being defined by a back wall portion, having an eighth predetermined configuration, and a second pair of side wall portions, having a ninth predetermined configuration;

(l) a third opening, having a tenth predetermined configuration, formed through a first one of said second pair of side wall portions of said second cavity;

(m) an axially opposed fourth opening, having an eleventh predetermined configuration, formed through a second one of said second pair of side wall portions of said second cavity;

(n) a second male connection member having a twelfth predetermined configuration, at least a portion of a first end of said second male connection member being movably disposed within said second cavity formed in said second female connection member;

(o) a second aperture formed through a predetermined portion of said second male connection member adjacent said first end thereof;

(p) a second spherical shaped member, at least a portion of said second spherical shaped member being disposed within said second aperture formed through said first end of said second male connection member;

(q) a second pair of horizontally disposed shaft members extending outwardly for a predetermined distance from axially opposed outer surfaces of said second spherical shaped member, at least a portion of a first one of said second pair of shaft members being disposed within said third opening formed through said first one of said second pair of side wall portions and at least a portion of a second one of said second pair of shaft members being disposed within said fourth opening formed through said second one of said second pair of side wall portions, each respective one of said second pair of shaft members has an axially opposed and substantially flat surface portion formed thereon;

(r) a second race assembly having at least a portion thereof disposed within said second aperture and secured to said first end of said second male connection member, an inner surface of said second race assembly being disposed around said portion of said second spherical shaped member disposed within said second aperture formed in said second male connection member;

(s) a means engageable with a second end of said first male connection member and a second end of said second male connection member for securing said second end of said first male connection member to said second end of said second male connection member;

(t) a first pair of wedge means, a first one of said first pair of wedge means being engaged with a first one of said axially opposed and substantially flat surface portions formed on said first pair of shaft members and a second one of said first pair of wedge means being engaged with a second one of said axially opposed and substantially flat surface portions formed on said first pair of shaft members; and (u) a second pair of wedge means, a first one of said second pair of wedge means being engaged with a first one of said axially opposed and substantially flat surface portions formed on said second pair of shaft members and a second one of said second pair of wedge means being engaged with a second one of said axially opposed and substantially flat surface portions formed on said second pair of shaft members.

2. An improved slackless type drawbar assembly, according to claim 1, wherein said assembly further includes a substantially solid type lubricating liner member disposed intermediate an outer surface of said first spherical shaped member and said inner surface of said first race assembly.

3. An improved slackless type drawbar assembly, according to claim 2, wherein said assembly further includes a substantially solid type lubricating liner member disposed intermediate an outer surface of said second spherical shaped member and said inner surface of said second race assembly.

4. An improved slackless type drawbar assembly, according to claim 1, wherein said means engageable said second end of said first male connection member and said second end of said second male connection member for securing said second end of said first male connection member to said second end of said second female connection member is a weldment.

5. An improved slackless type drawbar assembly, according to claim 1, wherein said means engageable said second end of said first male connection member and said second end of said second male connection member for securing said second end of said first male connection member to said second end of said second female connection member includes at least one of a bar-like and a pipe-like member disposed intermediate and secured to said second end of said first male connection member and said second end of said second male connection member.

6. An improved slackless type drawbar assembly, according to claim 5, wherein said pipe-like member is disposed intermediate and secured to said second end of said first male connection member and said second end of said second male connection member and each of said second end of said first male connection member and said second end of said second male connection member include a male member inserted into respective opposed ends od said pipe-like member.

7. An improved slackless type drawbar assembly, according to claim 1, wherein a shape of outer surface portions of said first female connection member is designed in a manner such that said first female connection member can be disposed substantially entirely within and engaged to a first end of such center sill portion of such first railway car.

8. An improved slackless type drawbar assembly, according to claim 7, wherein a shape of outer surface portions of said second female connection member is designed in a manner such that said second female connection member can be disposed substantially entirely within and engaged to an adjacent end of such center sill portion of such second railway car.

9. An improved slackless type drawbar assembly, according to claim 1, wherein said second predetermined configuration of said inner surface of said back wall portion of said first female connection member will be generally concave in both a vertical direction and a horizontal direction.

10. An improved slackless type drawbar assembly, according to claim 9 wherein said third predetermined configuration of said inner surfaces of each of said first pair of side wall portions of said first female connection member will be generally convex shaped in at least a horizontal direction.

11. An improved slackless type drawbar assembly, according to claim 10, wherein said third predetermined configuration of said inner surfaces of each of said first pair of side wall portions of said first female connection member will be generally convex shaped in both a horizontal direction and a vertical-direction.

12. An improved slackless type drawbar assembly, according to claim 1, wherein said eighth predetermined configuration of said inner surface of said back wall portion of said second female connection member will be generally concave in both a vertical direction and a horizontal direction.

13. An improved slackless type drawbar assembly, according to claim 12, wherein said ninth predetermined configuration of said inner surfaces of each of said second pair of side wall portions of said second female connection member will be generally convex shaped in at least a horizontal direction.

14. An improved slackless type drawbar assembly, according to claim 12, wherein said ninth predetermined configuration of said inner surfaces of each of said second pair of side wall portions of said second female connection member will be generally convex shaped in both a horizontal direction and a vertical direction.

15. An improved slackless type drawbar assembly, according to claim 1, wherein said first end of said first male connection member is generally rectangular in shape.

16. An improved slackless type drawbar assembly, according to claim 15, wherein said first end of said second male connection member is generally rectangular in shape.

17. An improved slackless type drawbar assembly, according to claim 16, wherein said first end of said second male connection member includes a surface, disposed facing said inner surface of said back wall portion of said second female connection member, which is convex shaped in each of a vertical direction and a horizontal direction.

18. An improved slackless type drawbar assembly, according to claim 15, wherein said first end of said first male connection member includes a surface, disposed facing said inner surface of said back wall portion of said first female connection member, which is convex shaped in each of a vertical direction and a horizontal direction.

19. An improved slackless type drawbar assembly, according to claim 1, wherein said fourth predetermined configuration of said first opening formed through said first one of said first pair of side wall portions and said fifth predetermined configuration of said axially opposed second opening formed through said second one of said first pair of side wall portions will at least include a generally round portion and a generally open bottom portion.

20. An improved slackless type drawbar assembly, according to claim 19, wherein said tenth predetermined configuration of said third opening formed through said first one of said second pair of side wall portions and said eleventh predetermined configuration of said axially opposed second opening formed through said second one of said second pair of side wall portions will at least include a generally round portion and a generally open bottom portion.

21. An improved slackless type drawbar assembly, according to claim 1, wherein said first aperture formed through said predetermined portion of said first male connection member adjacent said first end thereof is generally round and has a first predetermined diameter.

22. An improved slackless type drawbar assembly, according to claim 21, wherein said second aperture formed through said predetermined portion of said second male connection member adjacent said first end thereof is generally round and has a second predetermined diameter.

23. An improved slackless type drawbar assembly, according to claim 1, wherein said first race assembly is removably secured to said first end of said first male connection member.

24. An improved slackless type drawbar assembly, according to claim 23, wherein said second race assembly is removably secured to said first end of said second male connection member.

25. An improved slackless type drawbar assembly, according to claim 1, wherein said first spherical shaped member and said first pair of shaft members are formed as an integral single piece component.

26. An improved slackless type drawbar assembly, according to claim 25 wherein said second spherical shaped member and said second pair of shaft members are formed as an integral single piece component.

27. An improved slackless type drawbar assembly, according to claim 1, wherein said first spherical shaped member includes a chrome plating on at least a portion of an outer surface thereof.

28. An improved slackless type drawbar assembly, according to claim 27, wherein said second spherical shaped member includes a chrome plating on at least a portion of an outer surface thereof.

29. An improved slackless type drawbar assembly, according to claim 28, wherein said at least a portion of said chrome plated outer surface of said second spherical shaped member is polished.

30. An improved slackless type drawbar assembly, according to claim 27, wherein said at least a portion of said chrome plated outer surface of said first spherical shaped member is polished.

31. An improved slackless type drawbar assembly, according to claim 1, wherein said first pair of wedge means includes a first pair wedge members, each of said first pair of wedge members having a bolt disposed therethrough in a longitudinal direction and washer means, a first one of said first pair of wedge members includes a tapered surface engaged with a first flat surface portion of said axially opposed and substantially flat surface portions formed on said first pair of shaft members and a substantially flat and vertical surface disposed on said first one of said pair of wedge members is engaged with a mating vertical surface of a respective front draft stop member and a second one of such first pair of wedge members includes a tapered surface engaged with a second flat surface portion of said axially opposed and substantially flat surface portions formed on said first pair of shaft members, a substantially flat and vertical surface disposed on said second one of said first pair of wedge members engages with a mating vertical surface of a respective front draft stop member.

32. An improved slackless type drawbar assembly, according to claim 31, wherein said washer means are Belleville type washers.

33. An improved slackless type drawbar assembly, according to claim 32, wherein said second pair of wedge means includes a second pair wedge members, each of said second pair of wedge members having a bolt disposed therethrough in a longitudinal direction and washer means, a first one of said second pair of wedge members includes a tapered surface engaged with a first flat surface portion of said axially opposed and substantially flat surface portions formed on said second pair of shaft members and a substantially flat and vertical surface disposed on said first one of said second pair of wedge members is engaged with a mating vertical surface of a respective front draft stop member and a second one of such second pair of wedge members includes a tapered surface engaged with a second flat surface portion of said axially opposed and substantially flat surface portions formed on said second pair of shaft members, a substantially flat and vertical surface disposed on said second one of said second pair wedge members engages with a mating vertical surface of a respective front draft stop member.

34. An improved slackless type drawbar assembly, according to claim 33, wherein said washer means are Belleville type washers.

* * * * *

UNITED STATES PATENT AND TRADEMARK OFFICE

CERTIFICATE OF CORRECTION

PATENT NO. : 5,462,179

DATED : 10/31/95

INVENTOR(S) : David W. Daugherty, Jr., et al.

It is certified that error appears in the above-indentified patent and that said Letters Patent is hereby corrected as shown below:

Column 15, line 23, delete "od" and insert --of--;

column 15, line 54, delete the hyphen.

Signed and Sealed this

Seventh Day of May, 1996

Bruce Lehman

*Attest:*

BRUCE LEHMAN

*Attesting Officer*

*Commissioner of Patents and Trademarks*